US006657513B2

(12) United States Patent
Kawanami

(10) Patent No.: US 6,657,513 B2
(45) Date of Patent: Dec. 2, 2003

(54) NONRECIPROCAL CIRCUIT DEVICE AND COMMUNICATION APPARATUS INCLUDING THE SAME

(75) Inventor: Takashi Kawanami, Ishikawa-gun (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 106 days.

(21) Appl. No.: 09/978,916

(22) Filed: Oct. 16, 2001

(65) Prior Publication Data

US 2002/0047753 A1 Apr. 25, 2002

(30) Foreign Application Priority Data

Oct. 19, 2000 (JP) ..... 2000-319988
Oct. 19, 2000 (JP) ..... 2000-319989

(51) Int. Cl.[7] ..... H01P 1/36
(52) U.S. Cl. ..... 333/24.2; 333/1.1
(58) Field of Search ..... 333/1.1, 24.2; H01P 1/36, 1/383

(56) References Cited

U.S. PATENT DOCUMENTS 3,467,918 A * 9/1969 Dunn et al. ..... 333/1.1 X
3,836,874 A * 9/1974 Maeda et al. ..... 333/1.1
5,945,887 A * 8/1999 Makino et al. ..... 333/1.1

FOREIGN PATENT DOCUMENTS

JP 483461 1/1973
JP 5017949 2/1975
JP 5991007 6/1984 ..... H01P/1/387
JP 07283616 A * 10/1995 ..... H01P/1/383
JP 11298205 10/1999 ..... H01P/1/383

* cited by examiner

*Primary Examiner*—Robert Pascal
*Assistant Examiner*—Stephen E. Jones
(74) *Attorney, Agent, or Firm*—Keating & Bennett, LLP

(57) ABSTRACT

A nonreciprocal circuit device includes a resin-molded housing having an input terminal, an output terminal, and a ground terminal. The resin-molded housing includes a magnetic assembly composed of a central conductor and a ferrite member, a permanent magnet, and a spacer. The resin-molded housing includes a series capacitor which is connected to the input port of the central conductor, a parallel capacitor connected either between the input terminal and the ground terminal, or between the input port and the ground terminal, a parallel capacitor connected to the output port of the central conductor, a parallel capacitor connected to the terminating port of the central conductor, and a terminating resistor. The parallel capacitor connected to the terminating port may be replaced by a series capacitor, and in that case, an additional parallel capacitor may be provided between the series capacitor and the ground terminal. The top of the resin-molded housing is covered with an upper yoke. In the nonreciprocal circuit device, an arbitrary input impedance can be set, and the nonreciprocal circuit device has a low loss in the entirety thereof.

20 Claims, 7 Drawing Sheets

NONRECIPROCAL CIRCUIT DEVICE AND COMMUNICATION APPARATUS INCLUDING THE SAME

BACKGROUND OF THE INVENTION

1. Field of the Invention

The present invention relates to nonreciprocal circuit devices for use in microwave bands, such as isolators and circulators, and communication apparatuses including the devices.

2. Description of the Related Art

A nonreciprocal circuit device for use mainly in microwave bands has been used, having a resin housing having input and output terminals and a ground terminal, a central conductor in electric conduction to the input and output terminals and the ground terminal, a ferrite core close to the central conductor, a permanent magnet applying a static magnetic field to the ferrite core, and a terminating resistor provided in the terminating side of the central conductor are provided.

In a nonreciprocal circuit device of the above type, the central conductor has an input port, an output port, and a terminating-side port. Some specifications have been proposed for the uses of the ports. The specifications are described with reference to FIGS. 8A to 8C and 9A to 9C. FIG. 8A shows a nonreciprocal circuit device in which parallel capacitors are connected to all ports. FIG. 8B shows a nonreciprocal circuit device in which parallel capacitors are connected to all ports, and series coils and series capacitors are inserted. FIG. 8C shows a nonreciprocal circuit device in which parallel capacitors are connected to all ports, and series capacitors are inserted.

FIG. 9A shows a nonreciprocal circuit device in which parallel capacitors are connected to all ports, and a series coil and a series capacitor are inserted only in an input port. FIG. 9B shows a nonreciprocal circuit device in which parallel capacitors are connected to all ports, a series coil is inserted only in the input port, and a parallel capacitor is connected to the input end of the series coil. FIG. 9C shows a nonreciprocal circuit device in which parallel capacitors are connected to all ports, and a series coil and a series capacitor are inserted only in the terminating side.

The above conventional nonreciprocal circuit devices have the following problems.

According to the nonreciprocal circuit device in FIG. 8A, a low-loss, small-sized nonreciprocal circuit device can be formed by using a simple matching circuit, but the characteristic impedance thereof is fixed.

According to the nonreciprocal circuit device in FIG. 8B, a nonreciprocal circuit device can be formed which has broad ranges of characteristics in all the ports, such as insertion loss, isolation characteristic, and reflection loss, but an increased number of components increases the device size and cost, and a loss in each port increases.

According to the nonreciprocal circuit device in FIG. 8C, a nonreciprocal circuit device can be formed in which a characteristic impedance can be arbitrarily set in each port, but an increased number of components increases the loss of each port. When the circuit is formed so as to have a predetermined input impedance caused by a low resistance and to set the output impedance at 50 ohms, the exterior dimensions of the series capacitor in the output port increase. Specifically, for example, when the input impedance is 12 ohms and the output impedance is 50 ohms, the capacitances of the capacitors are as follows: the input-port series capacitor is 7 pF, the input-port parallel capacitor is 3 pF, the output-port series capacitor is 50 pF, and the 20 output-port parallel capacitor is 12 pF.

Accordingly, a capacitor having a large exterior size must be used as the output-port capacitor, so it is difficult to built the capacitor into the nonreciprocal circuit device. Also, when a laminated capacitor is used for size reduction, a new problem occurs in that the insertion loss increases because the Q value decreases in the microwave bands above about 1 GHz. For example, the Q value in the 1-GHz band of a laminated capacitor having 50 pF is approximately 10, so that an insertion loss of approximately 0.05 dB occurs.

In a case in which the nonreciprocal circuit device is used for connecting a circuit to an antenna, which is a main use of the nonreciprocal circuit device, there is a possibility that, because lightning can cause a large amount of static electricity to be stored in the series capacitor and parallel capacitor of the output port, the stored charge can exceed a withstand amount so as to heat and destroy the capacitor, or even components of the circuit. To prevent this problem, a resistor, an RF choke coil, or a surge absorber may be connected between the output terminal and the ground terminal. However, the loss and cost will increase, and size reduction becomes difficult.

In addition, in the process of producing a nonreciprocal circuit device, in general, the high frequency characteristics of the central conductor, the input and output terminals, and the ground terminal are inspected. Since measurement thereof takes a long time, in a pre-process before the inspection, the state of connection between the central conductor and the input and output terminals is inspected by using direct-current conduction. However, when the series capacitor is inserted between the central conductor and the input and output terminals, open-state detection by direct-current conduction cannot be performed, so that all nonreciprocal circuits must be inspected concerning high frequency characteristics. This increases the number of steps of production and the cost.

While the high frequency characteristic inspection is being performed, the central conductor is pressed onto the input and output terminal and the ground terminal. The pressure may warp the housing so that the respective portion between the central conductor and each terminal, which must be originally open, can be unstably connected, and the nonreciprocal circuit device may require further processing. Originally, the open state can be detected by the connection-state inspection using direct-current conduction. However, as described above, according to the nonreciprocal circuit device in FIG. 8C, it is difficult to prevent a defective product from being distributed since a series capacitor is inserted in each port.

The nonreciprocal circuit device in FIG. 9A attenuates a signal outside the targeted band because the input port has a broad range of reflection loss characteristics. However, since the coil is used, a magnetic path for preventing the deterioration of the Q value is separately required.

The nonreciprocal circuit device in FIG. 9B attenuates an unnecessary signal outside the targeted band (particularly on the high-frequency side). However, the device is enlarged since it has coils.

According to the nonreciprocal circuit device in FIG. 9C, a nonreciprocal circuit device can be formed which has a broad range of isolation characteristic despite low loss. However, the device is enlarged since it has coils.

SUMMARY OF THE INVENTION

The present invention provides a small-sized nonreciprocal circuit device in which an arbitrary input impedance can be set, in which matching to an arbitrary value of a terminating resistor can be performed, and which has a low loss in the entirety of the device. The invention also provides a communication apparatus provided with the nonreciprocal circuit device.

To this end, according to an aspect of the present invention, there is provided a nonreciprocal circuit device including a ferrite member, a central conductor having an input port, an output port, and a terminating port wherein the input port, the output port, the terminating port cross on the ferrite member, a permanent magnet applying a static magnetic field to the ferrite member and the central conductor, an input terminal and an output terminal for inputting and outputting a signal, and a ground terminal functioning as the ground. The nonreciprocal circuit device further includes a parallel capacitor connected between the output port and the ground terminal, a parallel capacitor connected between the terminating port and the ground terminal, a series capacitor connected between the input port and the input terminal, and a parallel capacitor connected between the input terminal and the ground terminal.

According to another aspect of the present invention, there is provided a nonreciprocal circuit device including a ferrite member, a central conductor having an input port, an output port, and a terminating port wherein the input port, the output port, the terminating port cross on the ferrite member, a permanent magnet applying a static magnetic field to the ferrite member and the central conductor, an input terminal and an output terminal for inputting and outputting a signal, a ground terminal functioning as the ground, and a terminating resistor connected to the terminating port. The nonreciprocal circuit device further includes a parallel capacitor connected between the output port and the ground terminal, a series capacitor connected between the input port and the input terminal, a parallel capacitor connected between the input terminal and the ground terminal, and a series capacitor connected between the terminating port and the terminating resistor.

Preferably, the nonreciprocal circuit device further includes a parallel capacitor connected between the terminating resistor and the ground terminal.

According to another aspect of the present invention, there is provided a nonreciprocal circuit device including a ferrite member, a central conductor having an input port, an output port, and a terminating port wherein the input port, the output port, the terminating port cross on the ferrite member, a permanent magnet applying a static magnetic field to the ferrite member and the central conductor, an input terminal and an output terminal for inputting and outputting a signal, and a ground terminal functioning as the ground. The nonreciprocal circuit device further includes a parallel capacitor connected between the output port and the ground terminal, a parallel capacitor connected between the terminating port and the ground terminal, a series capacitor connected between the input port and the input terminal, and a parallel capacitor connected between the input port and the ground terminal.

Preferably, the input port is disposed between the parallel capacitor and the series capacitor which are both connected to the input port. Also preferably, the input port is connected to a connection point defined between the parallel capacitor and the series capacitor which are both connected to the input port.

The parallel capacitor and the series capacitor may be single-substrate capacitors.

The input impedance of the input port may be in a range of 3 to 45 ohms.

The resistance of the terminating resistor may be in a range of 3 to 360 ohms.

According to another aspect of the present invention, there is provided a communication apparatus including one of the above nonreciprocal circuit devices.

According to the present invention, by employing a structure in which a parallel capacitor is connected between a ground terminal and each port of a central conductor and a series capacitor is inserted in an input port, a low-loss, small-sized nonreciprocal circuit device in which an input impedance can be arbitrarily selected can be inexpensively formed.

According to the present invention, by employing a structure in which a series capacitor is inserted in an input port, breakage of a circuit component by the inflow of static electricity from the outside via an output terminal can be prevented, and connection-state inspection using direct current conduction of the output terminal can be performed.

According to the present invention, a series capacitor is inserted in the input port of a central conductor, so that a direct-current component which flows in a nonreciprocal circuit device is excluded and an additional circuit for excluding the direct-current component is not required. This makes it possible to form an inexpensive, low-loss nonreciprocal circuit device.

According to the present invention, by employing a structure in which a series capacitor is inserted in the terminating port, a nonreciprocal circuit device in which an arbitrary value of a terminating resistor can be set can be formed.

According to the present invention, by employing a structure in which a parallel capacitor and a series capacitor which are connected to an input port are provided with the input port provided therebetween, a small-sized nonreciprocal circuit device can be formed.

According to the present invention, by using a single-substrate capacitor to form each capacitor, a low-loss, small sized nonreciprocal circuit device can be formed.

According to the present invention, by employing a structure in which an input impedance is set to 3 to 45 ohms, a nonreciprocal circuit device can be formed which has a low loss even when a circuit component required to have a load of low impedance is connected to the nonreciprocal circuit device.

According to the present invention, by employing a structure in which the resistance of a terminating resistor is to 3 to 360 ohms, a terminating resistor having a small number of parasitic components can be formed, and an inexpensive low-loss nonreciprocal circuit device can be formed.

According to the present invention, by employing a structure including one of the above nonreciprocal circuit devices, a small-sized communication apparatus having high communication performance can be inexpensively obtained.

Other features and advantages of the invention will be appreciated from the following detailed description of embodiments thereof, with reference to the drawings, in whidh like references denote like elements and parts.

DESCRIPTION OF EMBODIMENTS OF THE INVENTION

The structure of an isolator according to a first embodiment of the present invention is described below with reference to FIGS. 1A to 3.

Figure 1A:
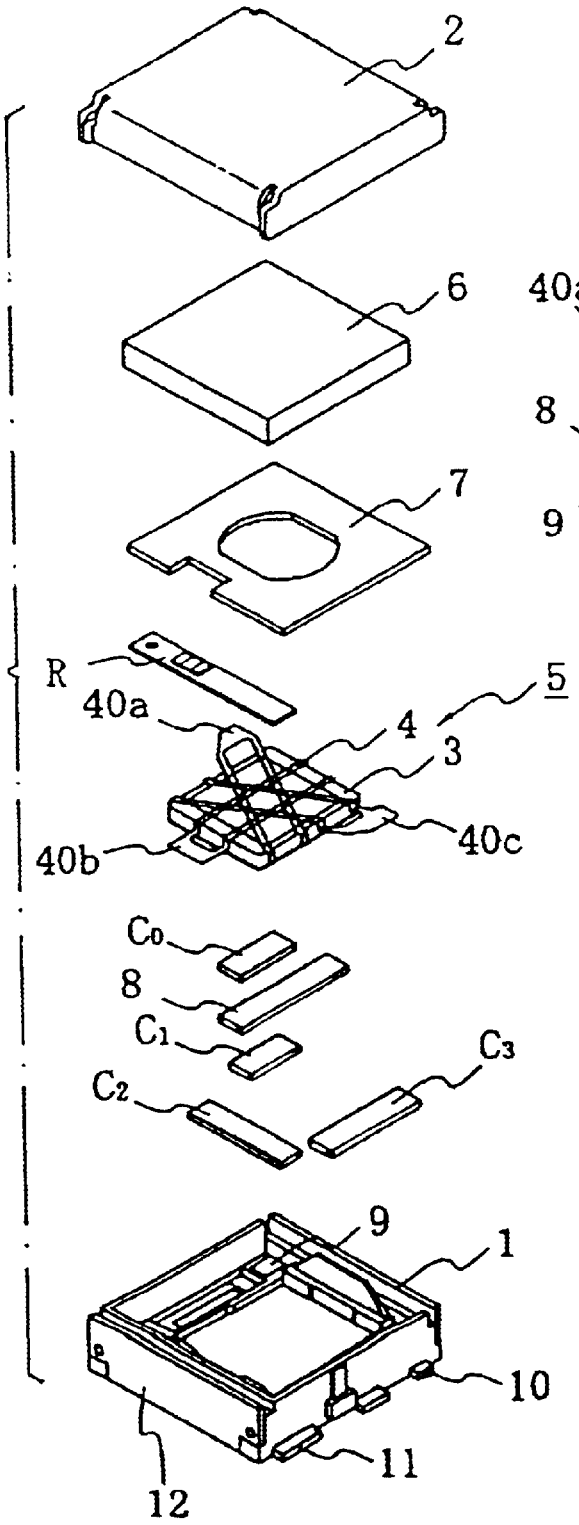
FIG. 1A is an exploded perspective view of an isolator according to a first embodiment of the present invention.
Figure 1B:
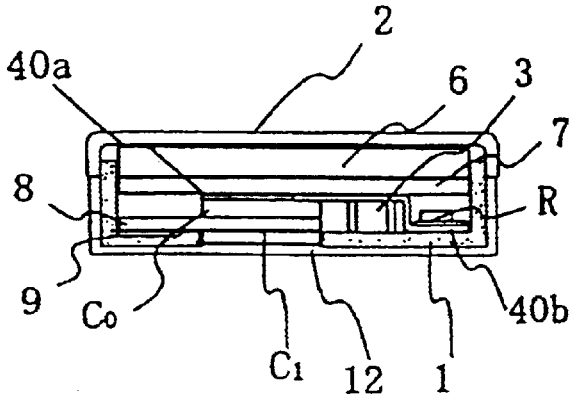
FIGS. 1B and 1C are section views of the isolator shown in FIG. 1A.
Figure 1C:
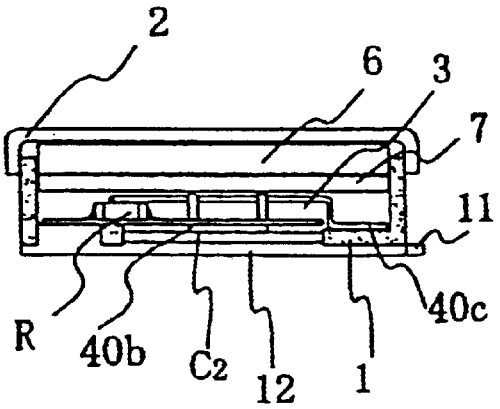
Figure 2:
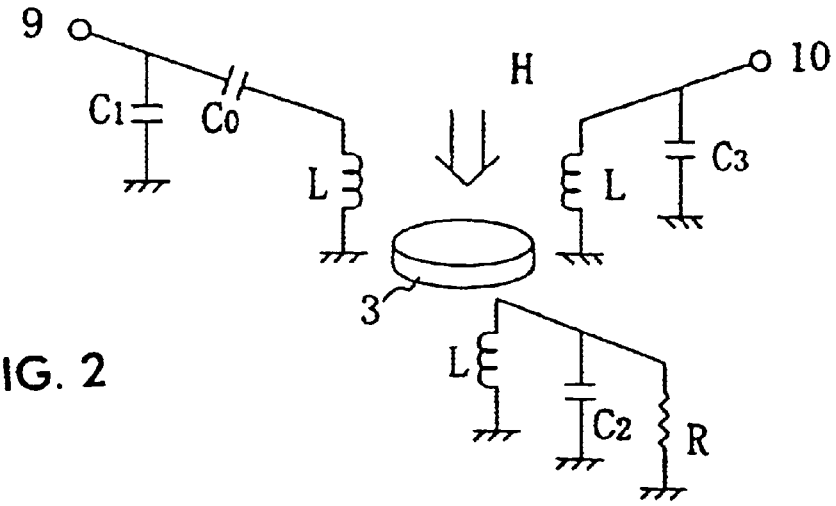
FIG. 2 is an equivalent circuit diagram of the isolator according to the first embodiment.
Figure 3:
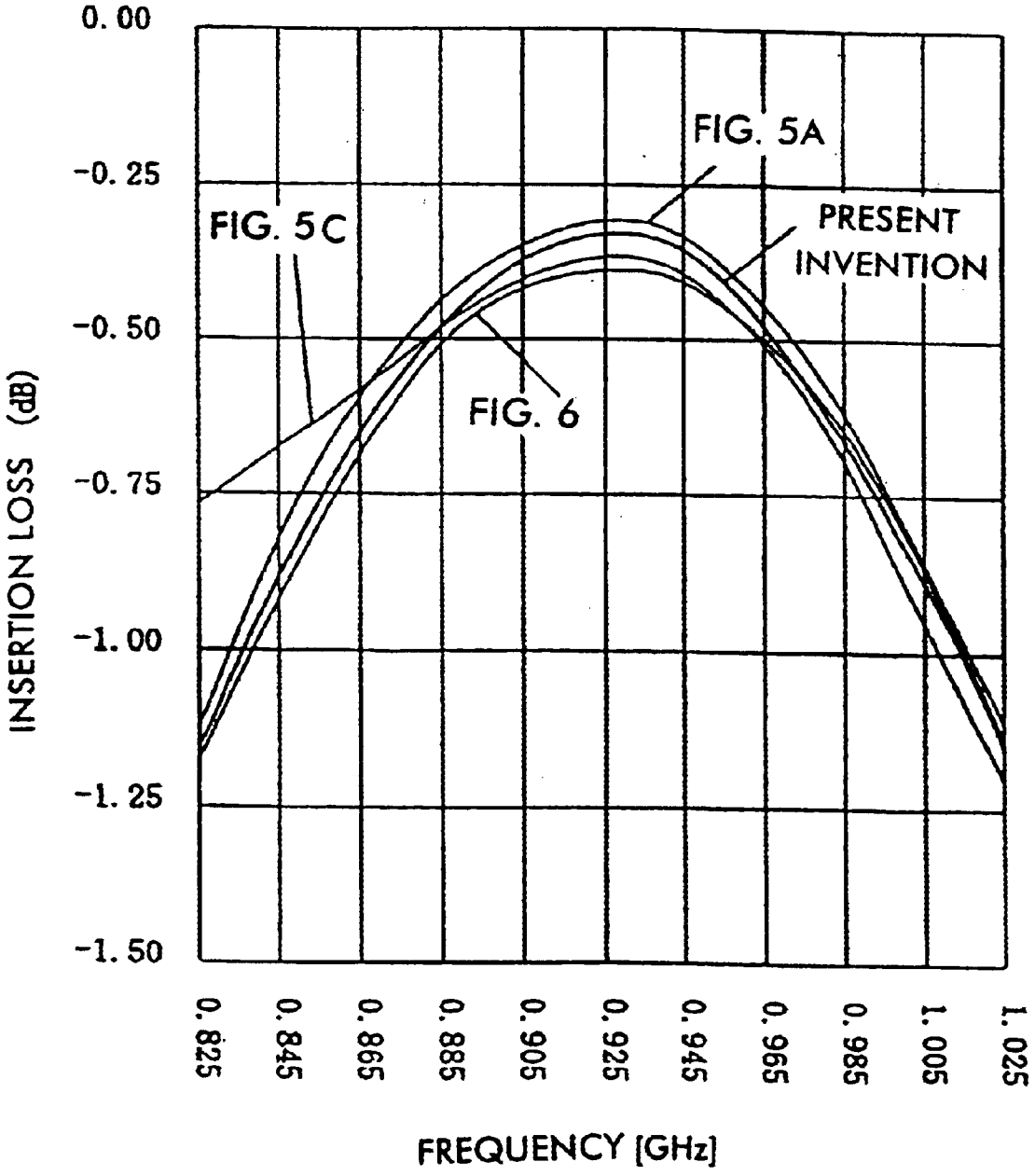
FIG. 3 is a graph showing differences in insertion-loss frequency characteristics which are caused by circuit arrangements.

FIG. 1A is an exploded perspective view of the isolator. FIG. 1B is a section view of the isolator on a plane passing through the input port of the isolator. FIG. 1C is a section view of the isolator on a plane passing through the output port of the isolator. FIG. 2 is an equivalent circuit diagram of the isolator. FIG. 3 shows differences in insertion-loss frequency characteristics which are caused by isolator arrangements.

Referring to FIG. 1A, the isolator is formed such that, in a resin-molded housing 1 having an input terminal 9, an output terminal 10, and a ground terminal 11 formed on a lower yoke 12, a magnetic assembly 5 composed of a central conductor 4 and a ferrite member 3, a permanent magnet which applies a static magnetic field to the magnetic assembly 5, a spacer 7 which separates the magnetic assembly 5 and the permanent magnet 6, capacitors C0, C1, C2, and C3 as matching devices, and a terminating resistor R are provided, and the top of the resin-molded housing 1 is covered with an upper yoke 2.

The equivalent circuit of the isolator is shown in FIG. 2. Referring to FIGS. 1A to 2, relationships among the input port 40*a* of the central conductor 4, the capacitors C0 and C1, the input terminal 9, and the ground terminal 11 are described.

Below the input port 40*a* of the central conductor 4, the capacitor C0, a connection plate 8 as a conductor, and the capacitor C1 are provided in the order given. The connection plate 8 has a bottom surface which partly abuts the top surface of the input terminal 9. The bottom surface of the capacitor C1 abuts the ground terminal 11 via the lower yoke 12.

The terminating port 40*b* of the central conductor 4 is electrically connected to the ground terminal 11 formed on the lower yoke 12 so that the capacitor C2 and the terminating resistor R are connected in parallel.

The output port 40*c* of the central conductor 4 is electrically connected to the ground terminal 11 formed on the lower yoke 12 via the output terminal 10 and the capacitor C3.

In the above-described arrangement, the isolator has both a portion which matches an input impedance while maintaining an equal resistance by inserting a series capacitor, and a portion which matches the input impedance while maintaining an equal conductance by connecting a parallel capacitor, so that the input impedance can be arbitrarily set.

Because matching devices are formed by the capacitors, device size can be reduced compared with the case of using coils, and the insertion loss can be reduced by approximately 0.1 dB.

The insertion of the series capacitor only in the input port enables size reduction and reduced loss of the device. For example, compared with the case of inserting the series capacitor in the output port, the insertion loss can be reduced by approximately 0.03 dB. Differences in insertion-loss frequency characteristics which are caused by the above difference in devices are shown in FIG. 3.

Because the series capacitor is not inserted in the output port 10, if a lightning surge, etc., flows in from an external device connected to the output terminal 10, such as an antenna, storage of a large amount of static electricity does not occur, so that a defect such as breakage can be prevented.

In addition, because the series capacitor is not inserted in the output port, and the output terminal 10 is directly connected to the ground terminal 11 via the central conductor 4, a conduction test using an application of a direct current is used to confirm the state of connection. By employing the conduction test, inspection can be performed without applying a strong external force to each terminal, deformation of the housing by an external force can be prevented, and an isolator which includes an unstable connection portion can be prevented from being shipped.

Because capacitors are more inexpensive than coils and are easily mounted, an isolator can be inexpensively formed. The insertion of the series capacitor in the input port 40*a* makes it possible to exclude a direct current component flowing into the isolator. This eliminates the need for adding a capacitor for excluding the direct current component to a pre-stage circuit connected to the isolator, so that a low-loss, inexpensive circuit device can be formed.

A laminated capacitor is normally used as the capacitor for excluding the direct current component. In a circuit of low impedance (3 to 45 ohms), the equivalent series resistance component of the capacitor greatly influences the loss. Accordingly, by using a single-substrate capacitor having a small equivalent series resistance component, a low-loss, inexpensive device can be formed compared with the case of using a laminated capacitor.

Single-substrate capacitors can be formed by simply cutting a single parent substrate. Thus, by using single-substrate capacitors as the capacitors C0, C1, C2, and C3, the device can be rapidly, inexpensively produced with high precision.

By employing a vertically stacked structure in which the input port 40*a* of the central conductor 4 is provided between the capacitor C0 (the series capacitor in the input port 40*a*) and the capacitor C1 (the parallel capacitor of the input port 40*a*), the plane area can be reduced. Moreover, since the capacitors C0 and C1 are formed by single-substrate capacitors, stacking the capacitors C0 and C1 does not cause an increase in the thickness direction, and as a result, the isolator thickness can be reduced.

By setting the input impedance to 3 to 45 ohms which is lower than an ordinary resistance of 50 ohms, when the device is connected to a circuit device (e.g., power amplifier) which needs to have a load of low impedance, an impedance conversion circuit can be easily formed. In other words, advantageously, a communication apparatus of the present invention can be driven by using a power supply having a low voltage of, for example, 3 volts, and the communication apparatus can exchange signals at low impedance. In contrast, when a signal is received from a circuit device (such as an active device of the power amplifier) having a load impedance of 3 to 5 ohms, and the impedance is converted into 50 ohms which is an ordinary input impedance of an isolator, while satisfying electric characteristics in the operating band, the loss is increased, so that a matching circuit for the circuit device which needs to have load of low impedance becomes complicated. Accordingly, by employing a structure in which the input impedance of the isolator is set to a predetermined value (e.g., 12 ohms) between 3 ohms and 50 ohms for exchanging power signals, a low-loss circuit can be formed.

Next, an isolator according to a second and a third embodiment of the present invention is described below with reference to FIGS. 4A and 4B, respectively.

Figure 4A:
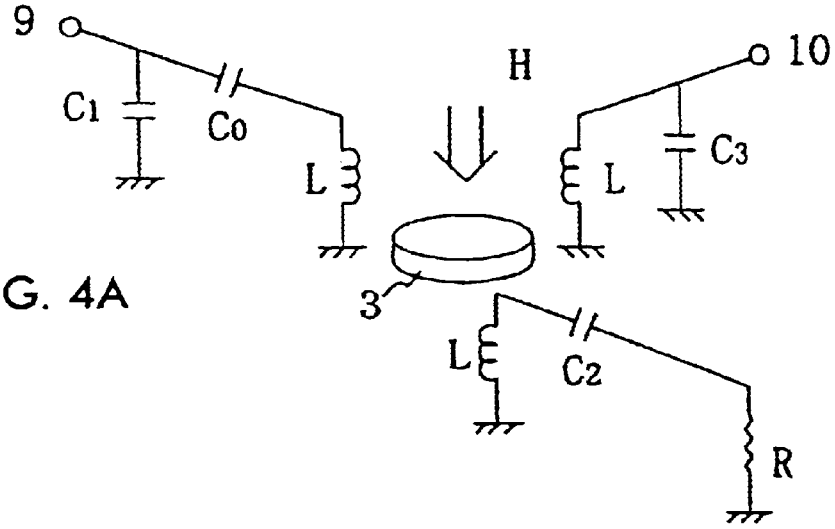
FIGS. 4A and 4B are equivalent circuit diagrams of an isolator according to a second and a third embodiment of the present invention, respectively.

The isolator in FIG. 4A is obtained by modifying the isolator according to the first embodiment, such that the parallel capacitor connected between the terminating port and the ground terminal is replaced by a series capacitor inserted between the terminating port and the terminating resistor.

Figure 4B:
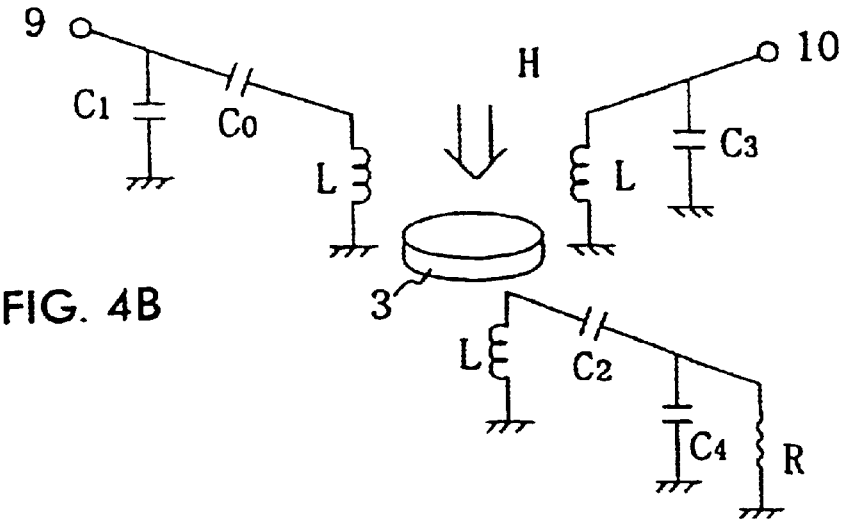

The isolator in FIG. 4B is obtained by modifying the isolator according to the first embodiment, such that a series capacitor is inserted between the terminating port and the parallel capacitor.

These arrangements make it possible to arbitrarily set the characteristic impedance in a broad range, similarly to that in the above input port. Specifically, when a crossing angle of the central conductor is in a normal range of 25 to 140 degrees so that predetermined characteristics can be obtained, the resistance of the terminating resistor is 100 to 360 ohms.

In the case of an isolator having a normal crossing angle of 120 degrees, the resistance of the terminating resistor is approximately 30 to 100 ohms. Thus, according to the structure of the conventional matching device, the setting of the crossing angle of the central conductor to the above range of 125 to 140 degrees causes impedance mismatching between the terminating port and the terminating resistor. Even in this case, by employing the circuit shown in FIG. 4A or 4B, a range of selectable resistors can be broadened, and a terminating resistor which has a desired resistance and provides a reduced number of parasitic components can be selected.

In addition, by employing a structure in which the resistance of the terminating resistor is set to 3 to 360 ohms, a terminating resistor which provides reduced parasitic components can be easily selected, and impedance matching between the terminating port and the terminating resistor can be performed, so that a low-loss isolator can be easily formed.

Next, an isolator according to a fourth embodiment of the present invention is described below with reference to FIGS. 5A to 6.

Figure 5A:
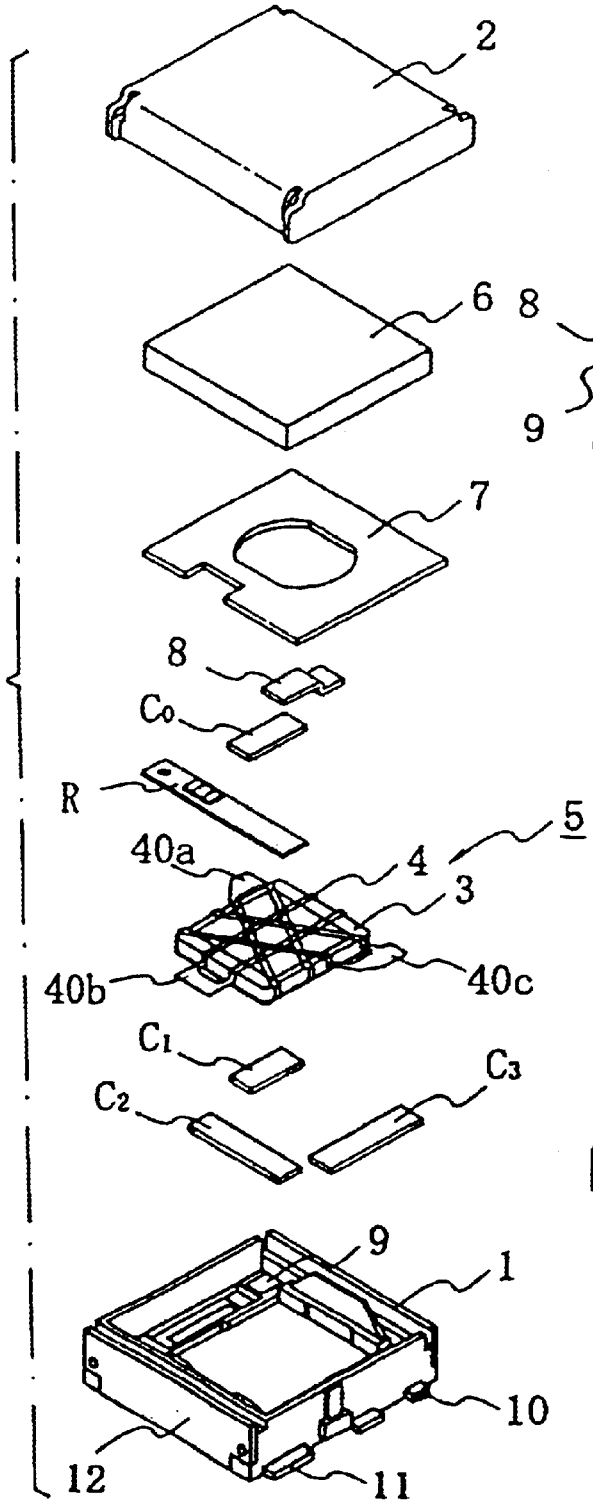
FIG. 5A is an exploded perspective view of an isolator according to a fourth embodiment of the present invention.
Figure 5B:
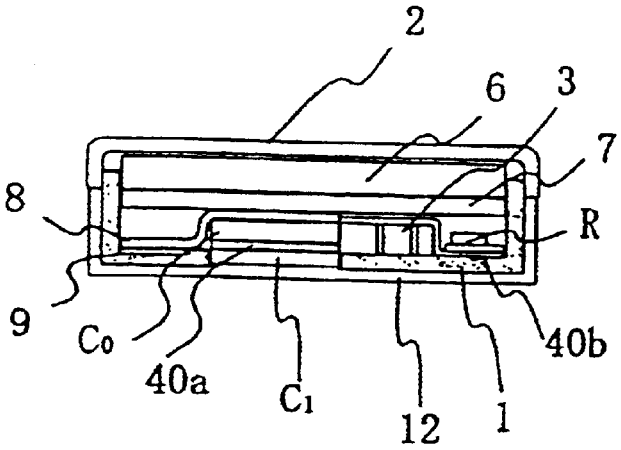
FIGS. 5B and 5C are section views of the isolator shown in FIG. 5A.
Figure 5C:
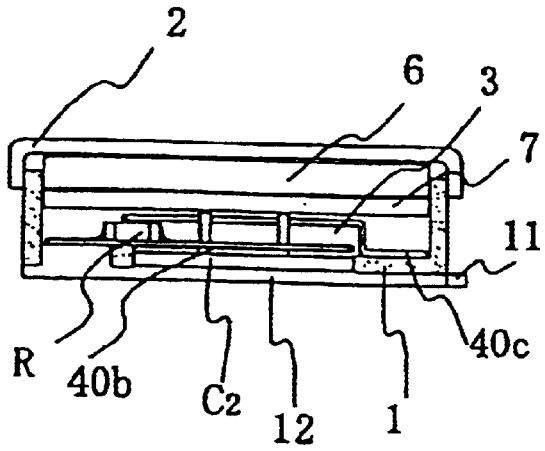
Figure 6:
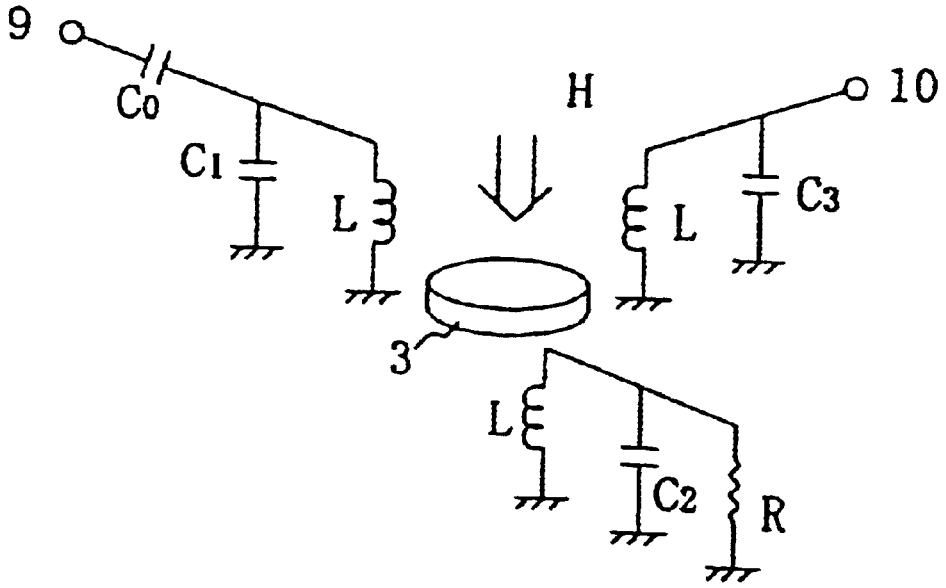
FIG. 6 is an equivalent circuit diagram of the isolator according to the fourth embodiment.

FIG. 5A is an exploded perspective view of the isolator. FIG. 5B is a section view of the isolator on a plane passing through the input port of the isolator. FIG. 5C is a section view of the isolator on a plane passing through the terminating port of the isolator. FIG. 6 shows an equivalent circuit of the isolator. Components which are identical to those in the isolator shown in FIGS. 1A–2 are denoted by identical reference numerals, and a description thereof is omitted.

The fourth embodiment differs from the first embodiment in the following points. Specifically, the first embodiment has the parallel capacitor C1 connected between the input terminal 9 and the ground terminal 11, while the fourth embodiment has a parallel capacitor C1 connected between an input port 40*a* and a ground terminal 11. In the fourth embodiment, as shown in FIG. 5A, a capacitor C0 and a capacitor C1 are respectively provided above and below the input port 40*a* of a central conductor 4 so that the input port 40*a* is provided between the capacitors C0 and C1. A connection plate 8 is provided so that the top surface of the capacitor C1 and the input terminal 9 are in electric conduction. The bottom surface of the capacitor C1 is connected to the ground terminal 11 by a lower yoke 12.

By employing the circuit arrangement in the fourth embodiment, effects similar to those in the first embodiment can be realized. Next, the structure of a communication apparatus according to a fifth embodiment of the present invention is described below with reference to FIG. 7.

Figure 7:
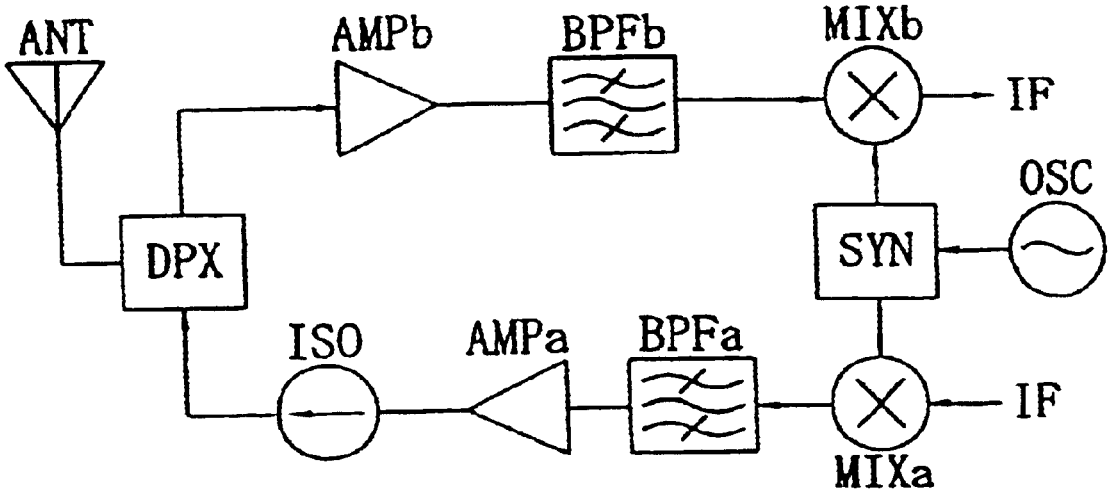
FIG. 7 is a block diagram of a communication apparatus according to a fifth embodiment of the present invention.
Figure 8A:
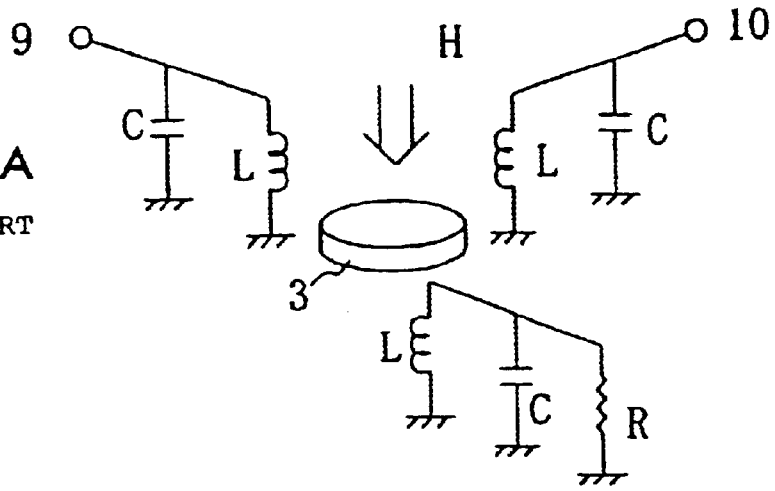
FIG. 8A PRIOR ART
FIGS. 8A, 8B, and 8C are equivalent circuit diagrams of a conventional nonreciprocal circuit device.
Figure 8B:
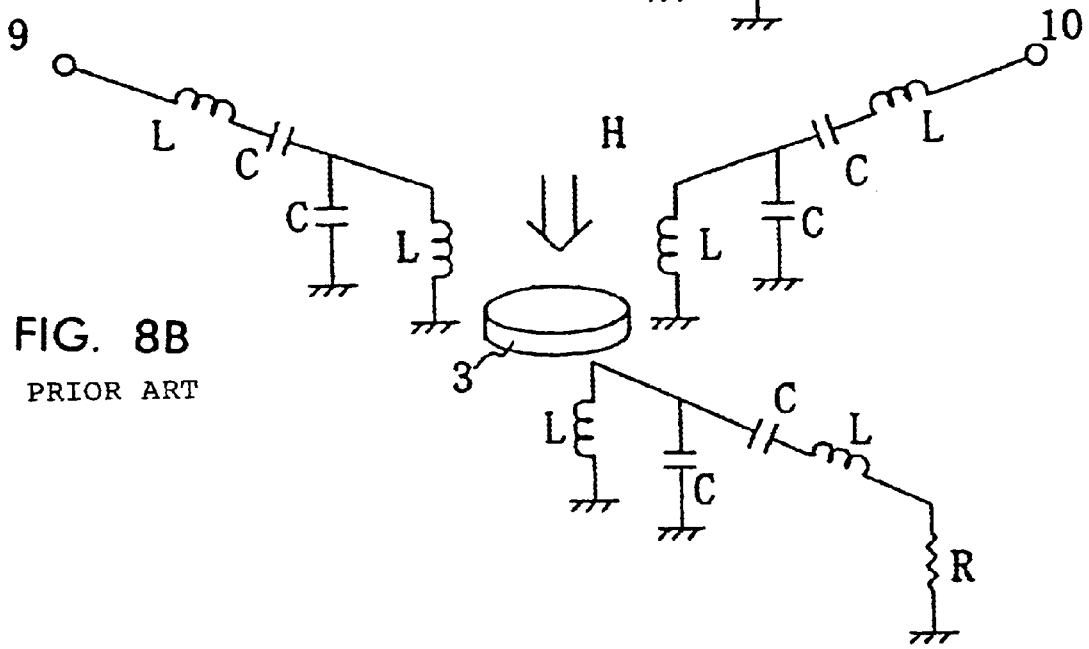
FIG. 8B PRIOR ART
Figure 8C:
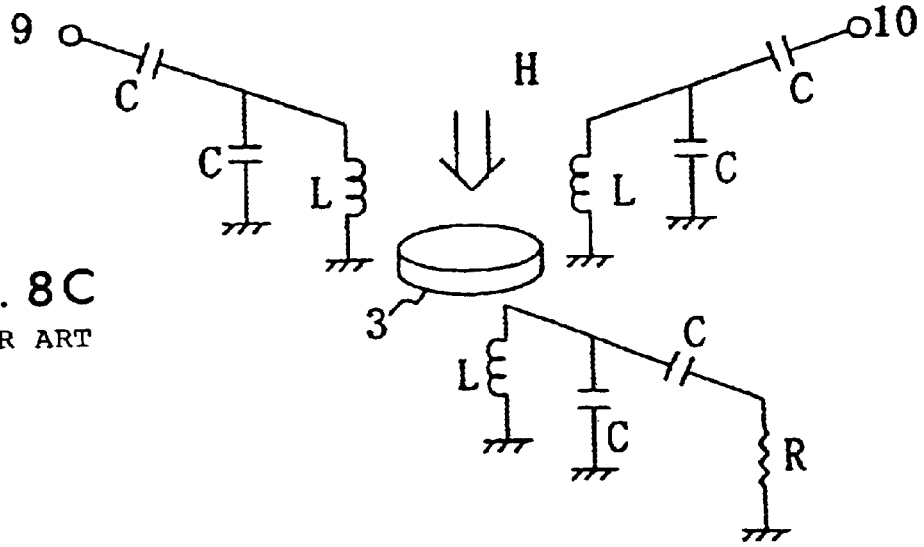
FIG. 8C PRIOR ART
Figure 9A:
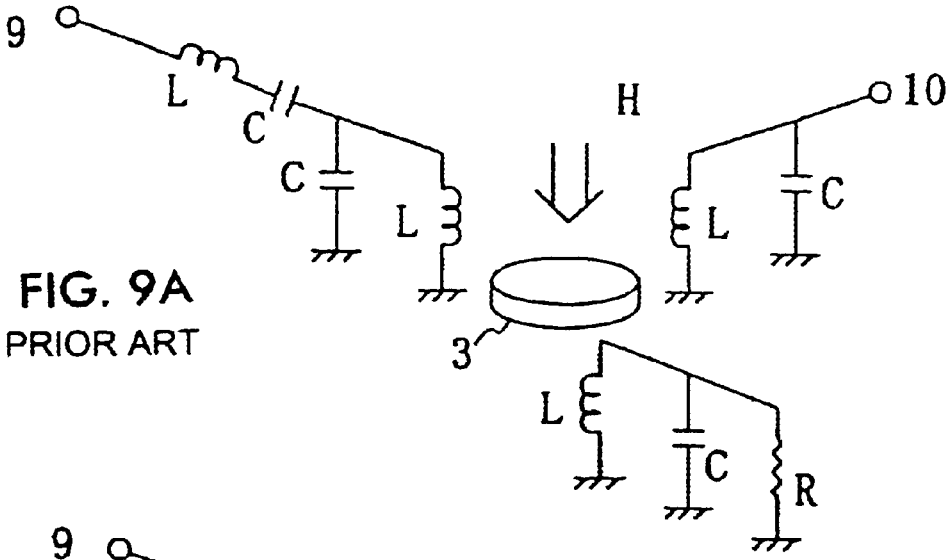
FIG. 9A PRIOR ART
FIGS. 9A, 9B, and 9C are equivalent circuit diagrams of a conventional nonreciprocal circuit device.
Figure 9B:
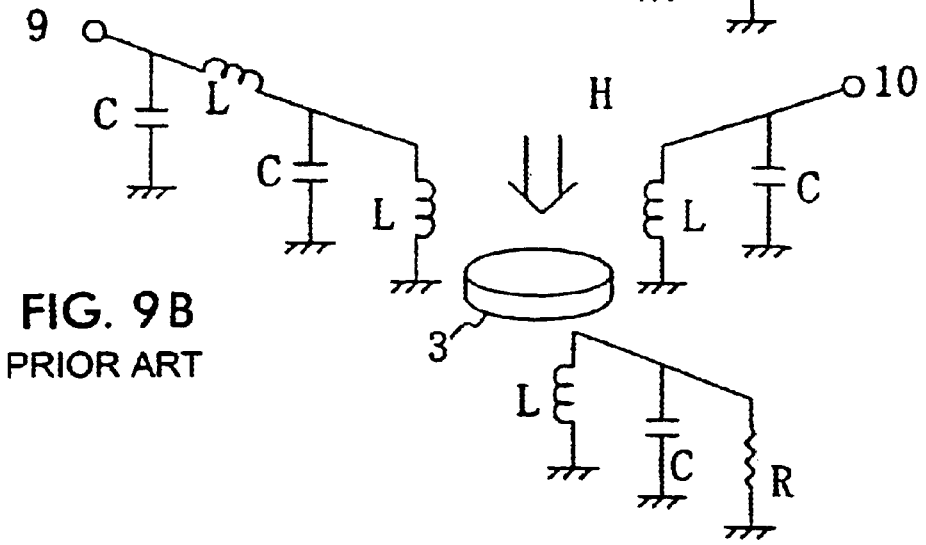
FIG. 9B PRIOR ART
Figure 9C:
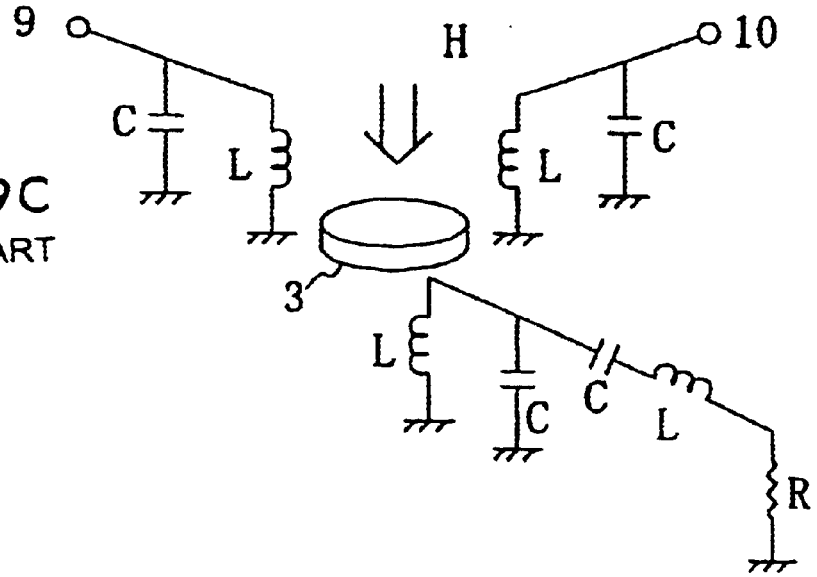
FIG. 9C PRIOR ART

The communication apparatus includes a transmitting/receiving antenna ANT, a duplexer DPX, bandpass filters BPFa and BPFb, amplifying circuits AMPa and AMPb, mixers MIXa and MIXb, an oscillator OSC, a frequency synthesizer SYN, and an isolator ISO, as shown in FIG. 7.

The mixer MIXa mixes an input IF signal and a signal output from the synthesizer SYN. The bandpass filter BPFa allows only a transmitting frequency band of a mixed signal output from the mixer MIXa to pass through it. The amplifying circuit AMPa performs power amplification of the transmitting frequency band. The amplified signal is transmitted from the antenna ANT via the isolator ISO and the duplexer DPX. The isolator ISO prevents noise from occurring in the amplifying circuit AMPa by blocking a reflection signal from the duplexer DPX or the like to the amplifying circuit AMPb. The amplifying circuit AMPb amplifies a received signal which is extracted from the duplexer DPX. The bandpass filter BPFb allows only a received frequency band of the amplified signal output from the amplifying circuit AMPb to pass through it. The mixer MIXb mixes a frequency signal output from the synthesizer and the received frequency-band signal, and outputs an intermediate frequency signal IF.

The isolator described in the first, second, or third embodiment may be used as the isolator ISO in FIG. 7.

As described above, by using a nonreciprocal circuit device which has a low insertion loss and which has a small size, a small-sized communication apparatus having a high power efficiency in the entirety thereof can be obtained.

Although embodiments of the invention have been described herein, the invention is not so limited, but extends to all modifications, variations and other uses that would occur to those having the ordinary level of skill in the pertinent art.

What is claimed is:

1. A nonreciprocal circuit device comprising:

a ferrite member;

a central conductor having an input port, an output port, and a terminating port wherein said input port, said output port, said terminating port cross on said ferrite member;

a permanent magnet applying a static magnetic field to said ferrite member and said central conductor; an input terminal and an output terminal for inputting and outputting a signal; and a ground terminal for functioning as the ground of the device;

wherein said nonreciprocal circuit device further comprises:

a parallel capacitor connected between said output port and said ground terminal;

a parallel capacitor connected between said terminating port and said ground terminal;

a series capacitor sandwiched directly between said input port and said input terminal; and a parallel capacitor sandwiched directly between said input terminal and said ground terminal; and said parallel capacitor sandwiched directly between said input terminal and said ground terminal and said series capacitor sandwiched directly between said input port and said input terminal are stacked vertically.

2. A nonreciprocal circuit device according to claim 1, wherein said parallel capacitor and said series capacitor are single-substrate capacitors.

3. A nonreciprocal circuit device according to claim 1, wherein the input impedance of said input port is in a range of 3 to 45 ohms.

4. A communication apparatus including at least one of a transmitting circuit and a receiving circuit, said circuit including a nonreciprocal circuit device according to claim 1.

5. A nonreciprocal circuit device comprising: a ferrite member;

a central conductor having an input port, an output port, and a terminating port wherein said input port, said output port, said terminating port cross on said ferrite member;

a permanent magnet applying a static magnetic field to said ferrite member and said central conductor;

an input terminal and an output terminal for inputting and outputting a signal;

a ground terminal for functioning as the ground of the device; and a terminating resistor connected to said terminating port;

wherein said nonreciprocal circuit device further comprises:

a parallel capacitor connected between said output port and said ground terminal;

a series capacitor connected between said input port and said input terminal;

a parallel capacitor sandwiched directly between said input terminal and said ground terminal; and a series capacitor sandwiched directly between said terminating port and said terminating resistor; and said parallel capacitor sandwiched directly between said input terminal and said ground terminal and said series capacitor sandwiched directly between said input port and said input terminal are stacked vertically.

6. A nonreciprocal circuit device according to claim 5, further comprising a parallel capacitor connected between said terminating resistor and said ground terminal.

7. A nonreciprocal circuit device according to claim 6, wherein said parallel capacitor and said series capacitor are single-substrate capacitors.

8. A nonreciprocal circuit device according to claim 6, wherein the input impedance of said input port is in a range of 3 to 45 ohms.

9. A nonreciprocal circuit device according to claim 6, wherein the resistance of said terminating resistor is in a range of 3 to 360 ohms.

10. A nonreciprocal circuit device according to claim 5, wherein said parallel capacitor and said series capacitor are single-substrate capacitors.

11. A communication apparatus including at least one of a transmitting circuit and a receiving circuit, said circuit including a nonreciprocal circuit device according to claim 5.

12. A nonreciprocal circuit device according to claim 5, wherein the input impedance of said input port is in a range of 3 to 45 ohms.

13. A nonreciprocal circuit device according to claim 5, wherein the resistance of said terminating resistor is in a range of 3 to 360 ohms.

14. A nonreciprocal circuit device comprising:

a ferrite member; a central conductor having an input port, an output port, and a terminating port wherein said input port, said output port, said terminating port cross on said ferrite member;

a permanent magnet applying a static magnetic field to said ferrite member and said central conductor;

an input terminal and an output terminal for inputting and outputting a signal; and a ground terminal for functioning as the ground of the device;

wherein said nonreciprocal circuit device further comprises:

a parallel capacitor connected between said output port and said ground terminal;

a parallel capacitor connected between said terminating port and said ground terminal;

a series capacitor sandwiched directly between said input port and said input terminal;

a parallel capacitor sandwiched directly between said input port and said ground terminal; and said parallel capacitor sandwiched directly between said input terminal and said ground terminal and said series capacitor sandwiched directly between said input port and said input terminal are stacked vertically.

15. A nonreciprocal circuit device according to claim 14, wherein said input port is disposed between said parallel capacitor and said series capacitor which are connected to said input port.

16. A nonreciprocal circuit device according to claim 15, wherein said parallel capacitor and said series capacitor are single-substrate capacitors.

17. A nonreciprocal circuit device according to claim 15, wherein the input impedance of said input port is in a range of 3 to 45 ohms.

18. A nonreciprocal circuit device according to claim 14, wherein said parallel capacitor and said series capacitor are single-substrate capacitors.

19. A nonreciprocal circuit device according to claim 14, wherein the input impedance of said input port is in a range of 3 to 45 ohms.

20. A communication apparatus including at least one of a transmitting circuit and a receiving circuit, said circuit including a nonreciprocal circuit device according to claims 14.

* * * * *